US005465693A

United States Patent [19]

Poole

[11] Patent Number: 5,465,693

[45] Date of Patent: Nov. 14, 1995

[54] MOTORCYCLE ENGINE IMPROVEMENT

[76] Inventor: Laurance L. Poole, 6417 Beaver Ridge Rd., Knoxville, Tenn. 37931

[21] Appl. No.: 234,053

[22] Filed: Apr. 28, 1994

[51] Int. Cl.[6] ..... F01M 11/02

[52] U.S. Cl. ..... 123/196 CP; 123/196 S

[58] Field of Search ..... 123/196 R, 196 CP, 123/196 M, 196 S, 196 W; 184/6.5

[56] References Cited

U.S. PATENT DOCUMENTS

| | | | |
|---|---|---|---|
| 1,407,442 | 2/1922 | Saives . | |
| 2,241,211 | 5/1941 | Mack . | |
| 3,824,973 | 7/1974 | Harhaus . | |
| 4,392,464 | 7/1983 | Woodward et al. . | |
| 4,630,580 | 12/1986 | Sawaki et al. . | |
| 4,649,873 | 3/1987 | Amano . | |
| 4,688,529 | 8/1987 | Mitadera et al. | 123/196 R |
| 4,944,265 | 7/1990 | Davey | 123/196 R |
| 4,947,812 | 8/1990 | Inoue et al. | 123/196 M |
| 5,074,379 | 12/1991 | Batrice . | |
| 5,113,818 | 5/1992 | Bonde et al. | 123/196 W |
| 5,228,536 | 7/1993 | Mohns . | |

FOREIGN PATENT DOCUMENTS

| | | |
|---|---|---|
| 4113437A | 10/1992 | Germany . |
| 224581 | 4/1924 | United Kingdom . |
| 231587 | 4/1925 | United Kingdom . |

*Primary Examiner*—Henry C. Yuen
*Assistant Examiner*—Erick Solis
*Attorney, Agent, or Firm*—Luedeka, Neely & Graham

[57] ABSTRACT

Air-cooled reciprocating engines usually have a lubrication and cooling oil system providing positive oil delivery to a valve operating mechanism above the cylinder heads and a gravity flow return to the crankcase. In many such engines, the flow return channels are bored or cast conduits within the cylinder jacket structure which surrounds the piston guiding cylinder sleeve. These cylinder jackets are assembled to the engine crankcase by several long drawbolts which clamp each jacket between the respective head and the crankcase. Cylinder jacket bases have turned cylindrical surfaces which socket into a corresponding bore in the crankcase against an annular face. The socket relationship between the jacket base and crankcase positionally confines the jacket base literally relative to the crankcase. Locator pins bridging the interface between the jacket and crankcase secure the jacket from rotation within the crankcase socket. A gasket compressed between the annular face at cylinder jacket base and a corresponding crankcase face is provided with an aperture to pass the crankcase return oil flow from the jacket drain conduit into a crankcase receiver conduit. To prevent oil from accumulating on mismatched edges and seeping past the gasket, a flexible conduit shunt tube axially extends from a threaded socket head screwed into the lower end of the jacket drain conduit with the tube extending past the interface and into the crankcase conduit.

16 Claims, 2 Drawing Sheets

MOTORCYCLE ENGINE IMPROVEMENT

BACKGROUND OF THE INVENTION

The present invention relates to oil circulation systems for internal combustion engines and particularly to the oil drain portions of circulation systems in air-cooled, overhead valve engines.

Harley-Davidson Evolution Model engines are of a 2 cylinder, air-cooled, gasoline (Otto cycle), 45° V design of relatively large displacement and long stroke. These engines have overhead valves operated by push rods and rocker arm assemblies.

Large displacement air cooled engines, such as the Harley-Davidson Evolution Model, are usually constructed with finned aluminum cylinders having thin cast iron sleeves within which the engine pistons reciprocate. A separate cylinder assembly is provided for each piston in the engine and is attached to a crankcase body in corresponding alignment with the crank shaft.

If the engine is of an overhead valve design, as is the Harley-Davidson Evolution, some means must be provided to pump lubricating oil past the length of the cylinder and into the valve rocker assembly in the cylinder head unit. Return flow of that valve rocker oil is usually under gravity force through one or more conduits that are either cast or bored within the cylinder jacket wall alongside the cylinder sleeve. This jacket conduit necessarily has a mating conduit in the crankcase unit which returns the oil to sump or pump pick-up.

The interface between the cylinder jacket oil return conduit and the crankcase oil return conduit frequently is a source of oil leakage due to failure of a gasket seal with the juxtaposed sealing face surfaces respective to the jacket and crankcase. Usually, the leakage rate is not great since the fluid conduit is unpressurized. Perhaps it is more appropriate to characterize the loss as seepage rather than leakage. In many cases, such seepage only occurs at a certain temperature range in the engine cooling cycle. Frequently, no seepage will occur when the engine is hot and running.

Although there are many techniques for positive transfer of a hot, unpressurized engine oil stream across an assembly unit interface that would avoid any possibility of leakage, such prior art techniques are complex with external conduits and fittings or expensive with close tolerance machined surfaces.

It is an object of the present invention, therefore, to provide an inexpensively applied method of sealing engine oil return conduits.

Another object of the present invention is to provide an inexpensively fabricated apparatus for transferring oil in an engine conduit across an assembly interface without leakage.

Another object of the present invention is to eliminate persistent oil leaks from Harley-Davidson Evolution model engines.

Another object of the present invention is to provide a method and apparatus for eliminating engine oil conduit leaks in either new or old engines.

SUMMARY OF THE INVENTION

These and other objects of the invention to be subsequently described are attained by the installation of an article within an engine oil return conduit that shunts a unit assembly interface as between a cylinder jacket and crankcase. Such an article comprises a socket head set screw of such size as is appropriate for the diameter of the upper engine assembly unit drain conduit. This set screw is axially thru-bored with an aperture sized to retain the internal socket wrench flats.

At the axial end of the set screw opposite from the wrench socket, a section of thin wall metallic tubing is brazed or welded to the set screw in co-axial alignment with the thru-bore.

The unit upper interface end of the drain conduit is cut

With a tapered end threading tap to receive the socket screw. Coated with a thread locking/sealing compound, the fabricated article is turned into the conduit threads with the screw socket head leading inwardly and the thin wall tubing projecting down beyond the unit sealing face. A hexagonal section Allen wrench of appropriate size is inserted along the conduit from the end opposite of the tubing projection and seated in the set screw socket for torquing into a firm seating. Upon engine reassembly, the projecting tubing is inserted into the mating crankcase conduit by manually bending and shaping the projecting tubing. Otherwise, the assembly is secured in the normal course.

BRIEF DESCRIPTION OF THE DRAWINGS

The invention is hereafter described relative to the drawings wherein.

DETAILED DESCRIPTION OF THE PREFERRED EMBODIMENT

Figure 1:
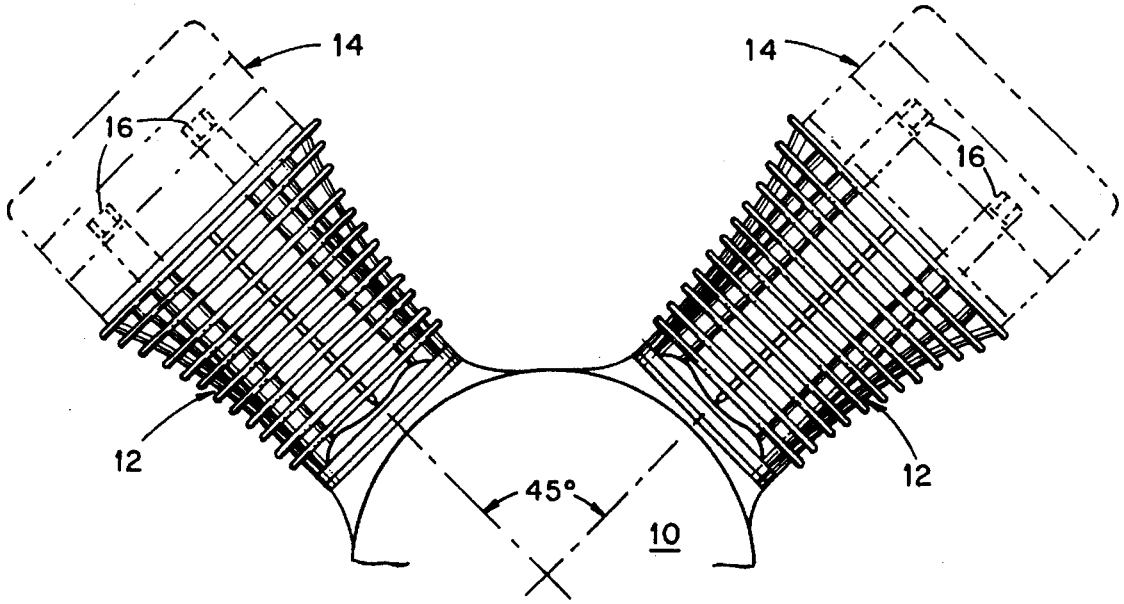
FIG. 1 is a partial elevational view of a Harley-Davidson Evolution Model engine.
Figure 2:
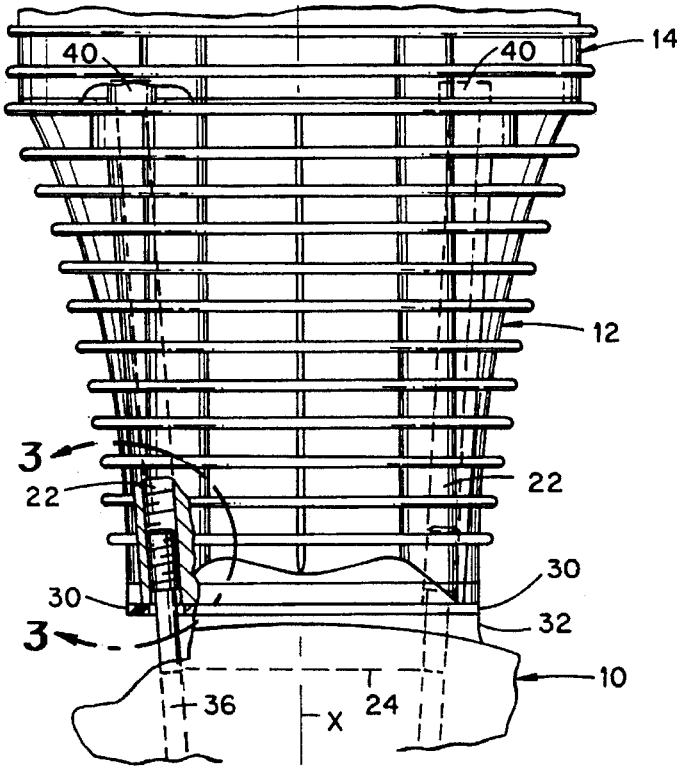
FIG. 2 is an exploded assembly view of the FIG. 1 engine showing the modification of the present invention.

Relative to the drawings wherein like reference characters designate like or similar elements throughout the several figures of the drawings, the present invention is particularly well adapted to correct engine oil seepage defects of Harley-Davidson Evolution model engines such as that represented by FIGS. 1 and 2. Air-cooled Evolution engines comprise a 45° –V assembly of two cylinder jackets 12 to a crankcase 10. The cylinder jackets 12 are finned aluminum castings topped by respective head assemblies 14. The heads, cylinder jackets and crankcase are clamped together as a single unit by head bolts 16 which seat at the wrench head ends against the heads 14 and engage the crankcase base 10 with screw threads.

Internally, the cylinder jackets 12 have a piston bore 20 lined by a thin cast iron cylinder sleeve 21. Crankshaft attached pistons, not shown, reciprocate within the bore 20 in sliding interface with the sleeve 21. Internal headbolt channels along the jacket length radially external of the cylinder sleeve loosely enclose the head bolt 16 shafts. Also within the cylinder jacket body outside of the cylinder sleeve 21 are lubricating oil return circulation channels 22.

Figure 3:
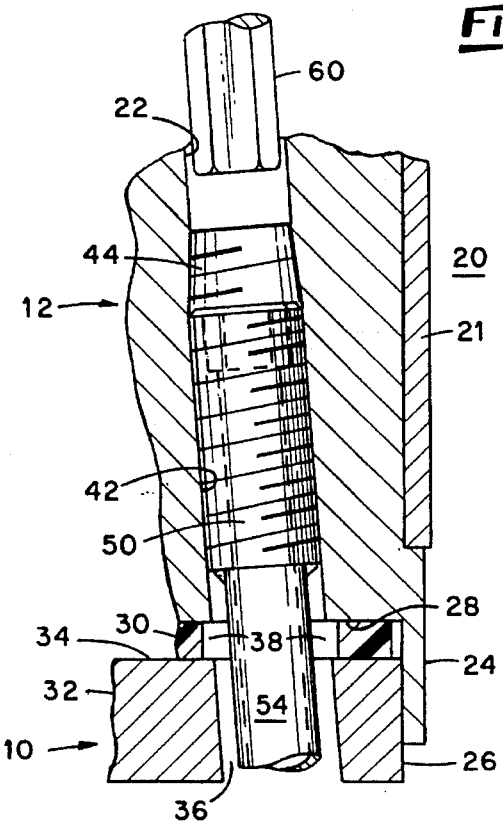
FIG. 3 is a section detail of the invention as applied to the engine unit of FIG. 2 at the circled area of detail 3—3.
Figure 4:
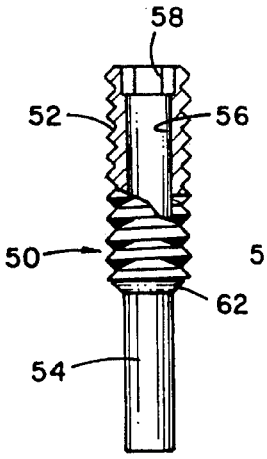
FIG. 4 is a partially sectioned elevation of the invention.
Figure 5:
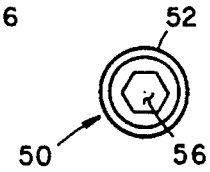
FIG. 5 is a plan view of the present invention.

With respect to FIG. 3, a base alignment skirt 24 projects from the cylinder jacket 12 base below and concentrically with the cylinder sleeve 21. This base alignment skirt 24 sockets within a receptacle boring 26 of crankcase 10 to secure the radial position of the jacket and sleeve 21 relative to the crankshaft and piston reciprocation axis.

Substantially normal of the alignment skirt 24, the base end of the cylinder jacket 12 has an annular sealing face 28 which compresses a gasket 30 against a corresponding sealing face 34 of the crankcase cylinder boss 32 under the compressive stress of headbolts 16.

At least one dowel pin, not shown, bridges the interface between seal surfaces 28 and 34 to angularly index and secure the required angular position of the cylinder jacket about the cylinder axis X.

An oil channel 36 in the crankcase 10 axially aligns with the oil return channel 22 in the cylinder jacket as does a matching aperture 38 in the gasket 30.

The engine head assembly 14 comprises structure to close and seal the head end of the cylinder bore 20. Additionally, valves and a rocker mechanism to operate the valves are secured to the head structure. Such structure within the head assembly 14 is not separately illustrated. The valve seals and rocker mechanism include many sliding and rotating surfaces operating in an extremely hot environment. Consequently, a significant flow of oil up to the rocker assembly is provided to lubricate and cool these surfaces. Weir rings 40 surround the head openings into the oil return channel 22 having a rim standoff from head floor to assure an oil pool around the mechanism.

A representative seal failure addressed by this invention typically occurs at the gasket 30 interface with seal surfaces 28 and 34 where the cylinder jacket oil return conduit 22 aligns with the crankcase conduit 36. After a number of heating and cooling cycles incident to engine operation combined with corresponding vibration, internal ledges are believed to form in the conduct channel that hold small pools of oil against the gasket interface. These suspected oil pools are constantly available to follow any opening across the seal area to the engine exterior.

To eliminate oil seepage at this point in the engine assembly, a thread is selected to correspond with the bore diameter of the jacket conduit 22. With the engine disassembled to the extent that the cylinder jacket 12 is isolated from the crankcase 10 and head assembly 14. A tapered end threading tap is turned into the conduit 22 from the seal face 28 end to provide a female thread run 42 of about ½ to 1 inch length having a tapered inner finish 44.

Into this female thread run 42 is turned a threaded shunt tube 50 comprising an externally threaded anchor end 52 and a flexible tube end 54. An internal conduit 56 is continuously open from end to end. At the distal end of the shunt tube anchor end 52 within the conduit 56 are the hexagonal flats of a tool socket 58.

The flexible tube end 54 is necessarily of a smaller outside diameter than the inside diameter of the crankcase drain conduit 36. The magnitude of permissible difference between tube 54 outside diameter and the conduit 36 inside diameter is largely dependent upon any flow axis mismatch between the two conduits upon engine assembly. One invention advantage is the capacity to manually bend and displace the flexible tube 54 to facilitate assembly; axial mismatch between the jacket and crankcase conduit notwithstanding.

Controlling length parameters for the skirt 50 include about ¾ inch or greater penetration of the crankcase conduit 36 below the crankcase boss face 34. On the upper end, the male thread section of the anchor end 52 should be above the jacket seal face 28.

The shunt tube 50 is securely seated into the thread runout taper 44 by the drive torque of an Allen wrench inserted into the wrench socket 58 from the upper head end of jacket conduit 22. A compound such as Loctite®242 may be used to assure an oil-tight thread seal position and retention.

Although there may be many methods and techniques for fabricating a shunt tube 50 as described above, including lathe turning from solid stock, a presently preferred construction calls for the center boring of a ⅜" nominal diameter, 16 threads per inch, ½" long, steel socket head drive set screw that has been modified by an axial drilling of the center conduit 56.

To the end of the drilled set screw distal from the tool socket 58, an appropriate length of metallic tubing is joined coaxially in a counterbore of the center conduit 56 and secured by a brazed or welded joint 62.

Regardless of the theoretical reason that flat-face gasket oil seals are unreliable for this type of service, the appliance and assembly method taught herein successfully eliminates the seepage problem. Accordingly, as My Invention,

I claim:

1. An oil circulation system for an internal combustion engine comprising the unitized assembly of crankcase means, cylinder body means and cylinder head means, said oil circulation system comprising a pumped oil supply to an overhead valve assembly within said cylinder head means and gravity drained crankcase return oil conduit means routed from said cylinder head means, through said cylinder body means across a gasket sealed interface between opposing gasket faces respective to said crankcase means and said cylinder body means, the improvement comprising a short length of taper terminated internal screw thread in said cylinder body advanced from said gasket face along said return oil conduit, said screw thread receiving therein an interface bridging length of malleable tubing having at least one end thereof formed with corresponding external screw thread and internal socket tool surfaces.

2. An oil circulation system as described by claim 1 wherein said internal screw thread is turned into said cylinder body about ½ inch to about 1 inch.

3. An oil circulation system as described by claim 1 wherein said external screw thread is turned into said internal screw thread beyond said cylinder body gasket face.

4. An oil circulation system as described by claim 1 wherein said length of malleable tubing extends into said crankcase return oil conduit means about ¾ inch or more below said crankcase means gasket face.

5. An oil circulation system as described by claim 1 wherein said length of malleable tubing is brazed in coaxial alignment with an axially bored socket head set screw.

6. A method of returning lubrication oil from a reciprocating engine overhead valve assembly through a gravity flow conduit that crosses a gasket sealed interface between gasket compression faces respective to cylinder body means and crankcase means, said method comprising the steps of tapping internal screw threads in said cylinder body means along said gravity flow conduit a short distance from said compression face to a tapered thread termination; turning into said internal screw threads, a short conduit body having external screw threads on at least one end thereof corresponding to said internal screw threads, a short length of malleable tubing being projected axially from the other end of said conduit body, a fluid flow channel provided axially through said conduit body and socket tool surfaces being formed within said flow channel at said one end of said conduit body.

7. A method as described by claim 6 wherein said internal screw threads are turned into said cylinder body means above the respective gasket compression face about ½ inch to about 1 inch.

8. A method as described by claim 6 wherein said external screw threads are turned into said internal screw threads above said cylinder body means compression face.

9. A method as described by claim 6 wherein said length of malleable tubing projects below said cylinder body means compression face about ¾ inch or more.

10. A method as described by claim 6 wherein a socket tool is inserted into said conduit body tool surfaces from an axially extended end of said cylinder body means flow conduit that opens into cylinder head means.

11. An air cooled reciprocating engine having a crankcase, at least one cylinder jacket and a cylinder head assembly corresponding to each cylinder jacket, a gasket sealed interface between seal faces respective to said crankcase and cylinder jacket, gravity drain conduit means through said cylinder jacket and crankcase for carrying return flow of lubricating oil from said cylinder head assembly across said gasket sealed interface, externally threaded conduit means turned into corresponding internal threads respective to said drain conduit means from the cylinder jacket seal face and unthreaded conduit means projected axially from said externally threaded means across said gasket sealed interface and into said crankcase.

12. An air cooled engine as described by claim 11 wherein said internal threads are cut along said drain conduit about ½ inch to about 1 inch from said cylinder jacket seal face.

13. An air cooled engine as described by claim 11 wherein said unthreaded conduit means projects axially into said crankcase about ¾ inch or greater.

14. A Harley-Davidson engine comprising the unitized assembly of a cylinder body with a crankcase and a cylinder head, said cylinder head including an overhead valve assembly receiving a pumped oil supply that is returned to said crankcase through a gravity drain conduit within said cylinder body and crankcase, said drain conduit crossing a gasket sealed interface between said cylinder body and said crankcase, malleable conduit means having external threads on one end thereof turned into corresponding threads in said cylinder body along said drain conduit with an unthreaded tail projected coaxially from the threaded one end into assembled penetration of said crankcase drain conduit.

15. A Harley-Davidson engine as described by claim 14 wherein said malleable conduit means external thread are turned into said cylinder body along said drain conduit about ½ inch to about 1 inch from said gasket sealed interface.

16. A Harley-Davidson engine as described by claim 14 wherein said unthreaded tail projects into assembled penetration of said crankcase drain conduit from said gasket sealed interface about ¾ inch or more.

* * * * *